US005522451A

United States Patent [19]

Lohikoski

[11] Patent Number: 5,522,451

[45] Date of Patent: Jun. 4, 1996

[54] METHOD TO PRODUCE HIGH FREQUENCY STOP-AND-GO MOVEMENT IN CONTINUOUS CAST ROD

[75] Inventor: Timo J. J. Lohikoski, Pori, Finland

[73] Assignee: Vertic Oy, Pori, Finland

[21] Appl. No.: 251,856

[22] Filed: May 3, 1994

Related U.S. Application Date

[63] Continuation of PCT/FI92/00142, May 5, 1992, abandoned.

[51] Int. Cl.[6] ..... B22D 11/12; B22D 11/128

[52] U.S. Cl. ..... 164/478; 164/484

[58] Field of Search ..... 164/484, 478, 164/477

[56] References Cited

U.S. PATENT DOCUMENTS

| | | | |
|---|---|---|---|
| 2,405,355 | 8/1946 | Harrison | 164/484 X |
| 3,397,773 | 8/1968 | Gricol . | |
| 3,494,411 | 2/1970 | Rehlman . | |
| 3,552,481 | 1/1971 | Gricol . | |
| 4,232,727 | 11/1980 | Bower et al. | 164/484 X |
| 4,763,719 | 8/1988 | Müller et al. . | |

FOREIGN PATENT DOCUMENTS

| | | | |
|---|---|---|---|
| 0305930 | 3/1989 | European Pat. Off. . | |
| 1-321045 | 12/1989 | Japan | 164/484 |
| 1-321046 | 12/1989 | Japan | 164/484 |
| 1-321044 | 12/1989 | Japan | 164/484 |
| 1458070 | 2/1989 | U.S.S.R. | 164/478 |
| 722314 | 1/1955 | United Kingdom . | |

*Primary Examiner*—J. Reed Batten, Jr.
*Attorney, Agent, or Firm*—Ladas & Parry

[57] ABSTRACT

A cast rod is swung from side to side to generate movement at the solidifying end of the rod. The drawing rolls operate simultaneously with steady (adjustable) speed. The swinging of the rod is generated between the upper end of the die cooler and the drawing rolls with e.g. a runner which is connected to an eccentric disk rotated by an electric motor. The amplitude and the frequency of the swinging and the speed of the drawing rolls can be varied and thus be used to achieve different movement forms in casting.

3 Claims, 1 Drawing Sheet

METHOD TO PRODUCE HIGH FREQUENCY STOP-AND-GO MOVEMENT IN CONTINUOUS CAST ROD

This is a continuation of copending application International Application PCT/FI92/00142 filed on May 5, 1992 and now abandoned.

BACKGROUND OF THE INVENTION

Quite common is a continuous casting method using a cooled formgiving die, made e.g. of graphite. This method is especially useful for casting products with rather small cross section, e.g. rods and bars. One application of this technique is horizontal casting, where the cast product is drawn through a horizontally situated die, and another where the cast product is drawn through the die vertically upwards. In recent years upwards casting has been developed so far that 8 mm thick wire rod can also be cast profitably. In this case a casting speed of 3–4 meter per minute at least is needed to keep the number of casting strands moderate. 8 mm wire rod can be drawn directly in bull-block drawing machine so e.g. no expensive cold rolling mill is needed in a first roughing step. Casting through a graphite die is done with a stop-and-go motion or strokewise. The casting of relatively thick products causes this strokewise movement no problems because the strokes are rather few per time unit. But when casting thin wire-like products several hundred strokes per minute are required to get the production needed. Because the stroke movement disturbs the solidification at the lower end of the wire rod and thus gives a structure with smaller grains, a subsequent cold working is advantageously employed. The fast acceleration of withdrawal machinery (drawing rolls, sprag clutch, lever etc.) and fast braking limits the frequency of the strokes.

SUMMARY OF THE INVENTION

The present invention differs from the aforesaid in that a cast rod is used to produce the stroke effect. The cast rod is deviated from its direct route between a solidification area and drawing rolls using e.g. a runner or slot driven by an eccentric and an electric motor. The driving rolls are rotated with a steady, controllable, speed which is the casting speed. The swinging masses are as small as possible in this solution. Because every round of the eccentric causes two strokes, it is easy to get thousands of strokes per minute. By controlling the frequency, the amplitude of the deviation and the speed of the drawing rolls, one can get different models of the movement for the strokes.

DETAILED DESCRIPTION

Figure 1:
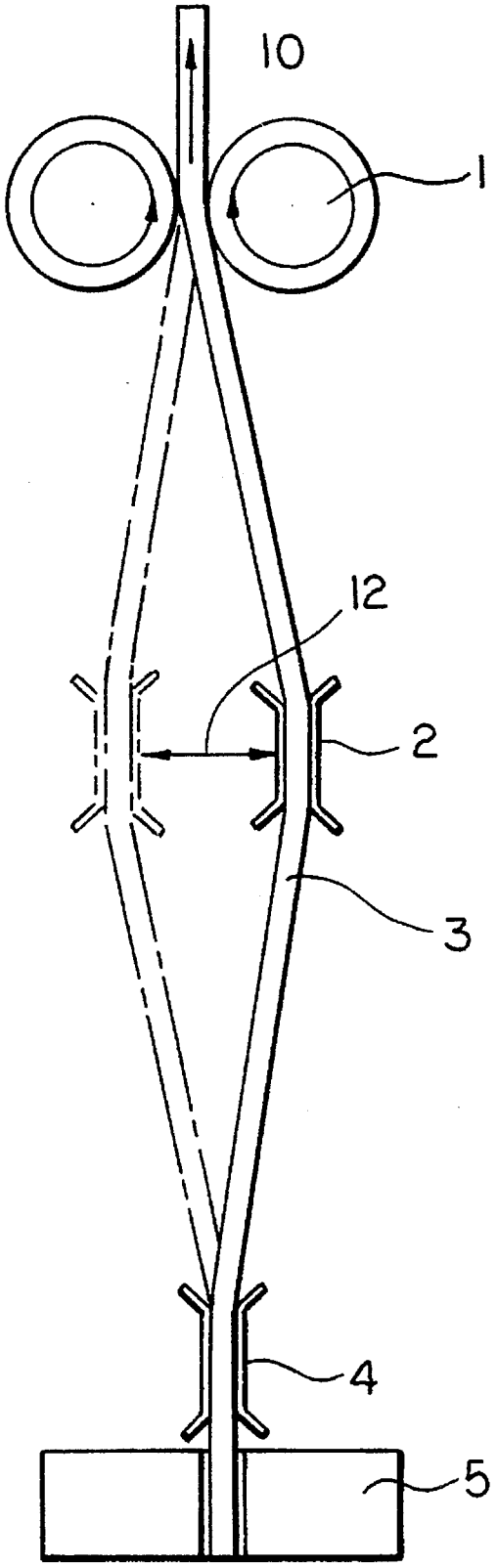
FIG. 1 is a side elevational view of a casting apparatus of the present invention.

In the attached drawing, FIG. 1 is a preferred embodiment of the invention:

Reference numeral 1 indicates a pair of drawing rolls, which are rotating with a steady speed drawing the cast product upwards in the direction shown by arrow 10.

Reference numeral 2 is a deviating runner, such as a pair of rolls etc., which is fastened rotatingly on an eccentric rotated by an electric motor (not shown). This gives back-and-forth movement to the runner in a direction 12 which is substantially perpendicular to the direction 10 of the cast product.

The cast product is a rod shown at reference numeral 3.

Reference numeral 4 is a sleeve or a couple of pairs of rolls which prevents the bending of rod 3 inside of the cooler 5. Only the uppermost part of cooler 5 is shown. At the lower end of cooler 5 there is a casting die, where the solidification takes place.

When the distance between drawing rolls 1 and cooler 5 is about one meter, the amount of deviation can be controlled so that no permanent deformation is caused.

I claim:

1. In a method for continuous casting of a rod wherein the rod being cast is drawn from a die cooler in a first direction, said rod having a cast end and a solidifying end, the improvement comprising imparting a swinging motion to the rod in a direction that is substantially perpendicular to the first direction whereby to cause a stroking movement to be applied to the solidifying end of the rod to produce smaller grains, said rod being drawn from the die cooler by drawing rolls along a direct route, said swinging motion being imparted to the rod such that a first portion of the rod lying between an upper end of the die cooler and the drawing rolls deviates from the direct route by an amplitude that is a multiple of a width of the rod, said amplitude being greater than an amplitude of deviation at a portion of the rod closer to the solidifying end.

2. A method as claimed in claim 1 wherein the rod is drawn in the first direction at a steady speed and wherein the swinging motion is imparted to the rod at a predetermined frequency, said method further comprising controlling the frequency, the amplitude, and the speed to regulate the stroking movement applied to the solidifying end.

3. A method as claimed in claim 2 wherein the product is a wire.

* * * * *